US005128174A

United States Patent [19]

Brotz

[11] Patent Number: 5,128,174

[45] Date of Patent: Jul. 7, 1992

[54] METALLIZED FIBER/MEMBER STRUCTURES AND METHODS OF PRODUCING SAME

[76] Inventor: Gregory R. Brotz, P.O. Box 1322, Sheboygan, Wis. 53081

[21] Appl. No.: 667,495

[22] Filed: Mar. 11, 1991

Related U.S. Application Data

[60] Division of Ser. No. 186,391, Apr. 26, 1988, Pat. No. 4,999,240, which is a continuation-in-part of Ser. No. 888,579, Jul. 21, 1986, abandoned, which is a continuation-in-part of Ser. No. 696,458, Jan. 30, 1985, abandoned.

[51] Int. Cl.[5] ..... B05D 3/06

[52] U.S. Cl. ..... 427/38; 162/147; 205/80; 427/439

[58] Field of Search ..... 162/147; 205/80; 427/38, 439

[56] References Cited

U.S. PATENT DOCUMENTS

| | | | |
|---|---|---|---|
| 4,042,737 | 8/1977 | Forsgren et al. | 428/96 |
| 4,132,828 | 1/1979 | Nakamura et al. | 428/366 |
| 4,257,835 | 3/1981 | Bompard | 264/29.2 X |
| 4,396,663 | 8/1983 | Mitchell et al. | 428/111 |
| 4,428,996 | 1/1984 | Miyoshi et al. | 428/288 X |
| 4,931,139 | 6/1990 | Phillips | 162/147 X |

*Primary Examiner*—Michael Lusignan
*Attorney, Agent, or Firm*—William Nitkin

[57] ABSTRACT

A structural material comprising a plurality of irregularly arranged members contacting one another with the points of contact forming junctions, the members being coated, which coating holds the members together to form a strong integral structural material and methods for producing same.

3 Claims, 11 Drawing Sheets

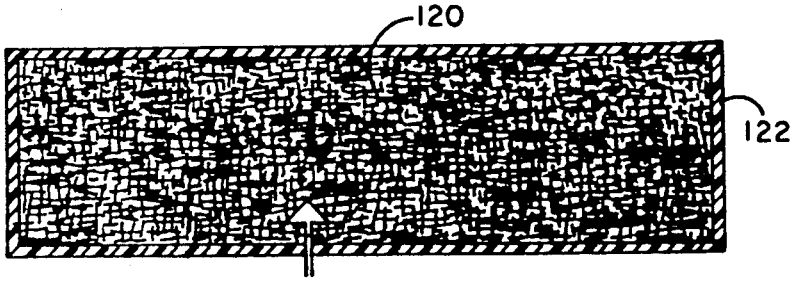
FIG. 8A
FIG. 8B
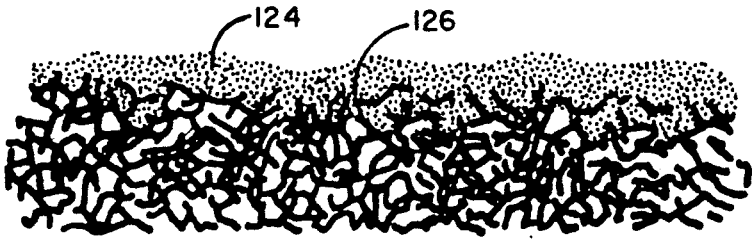
FIG. 8C
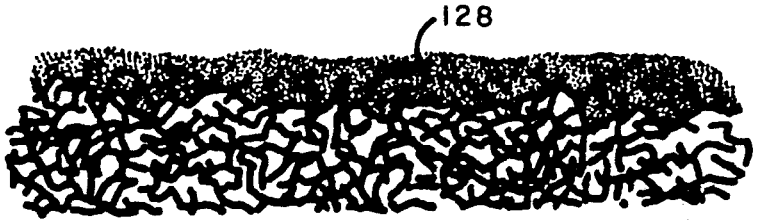

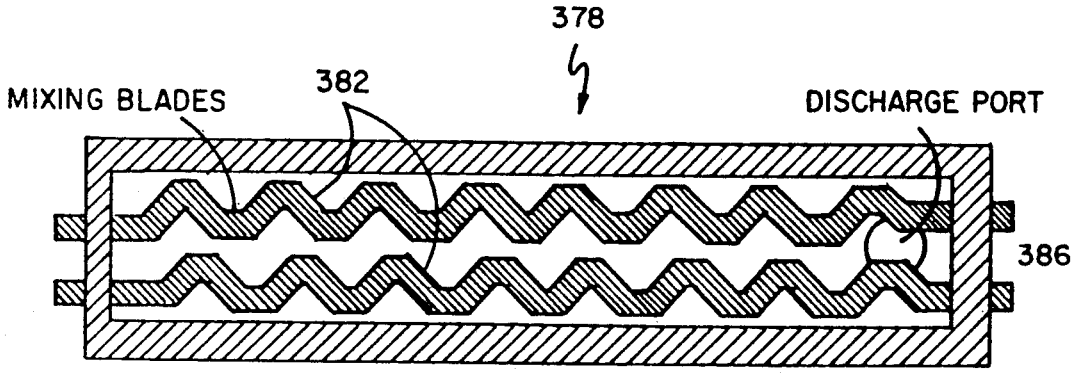
FIG. 19
FIG. 20
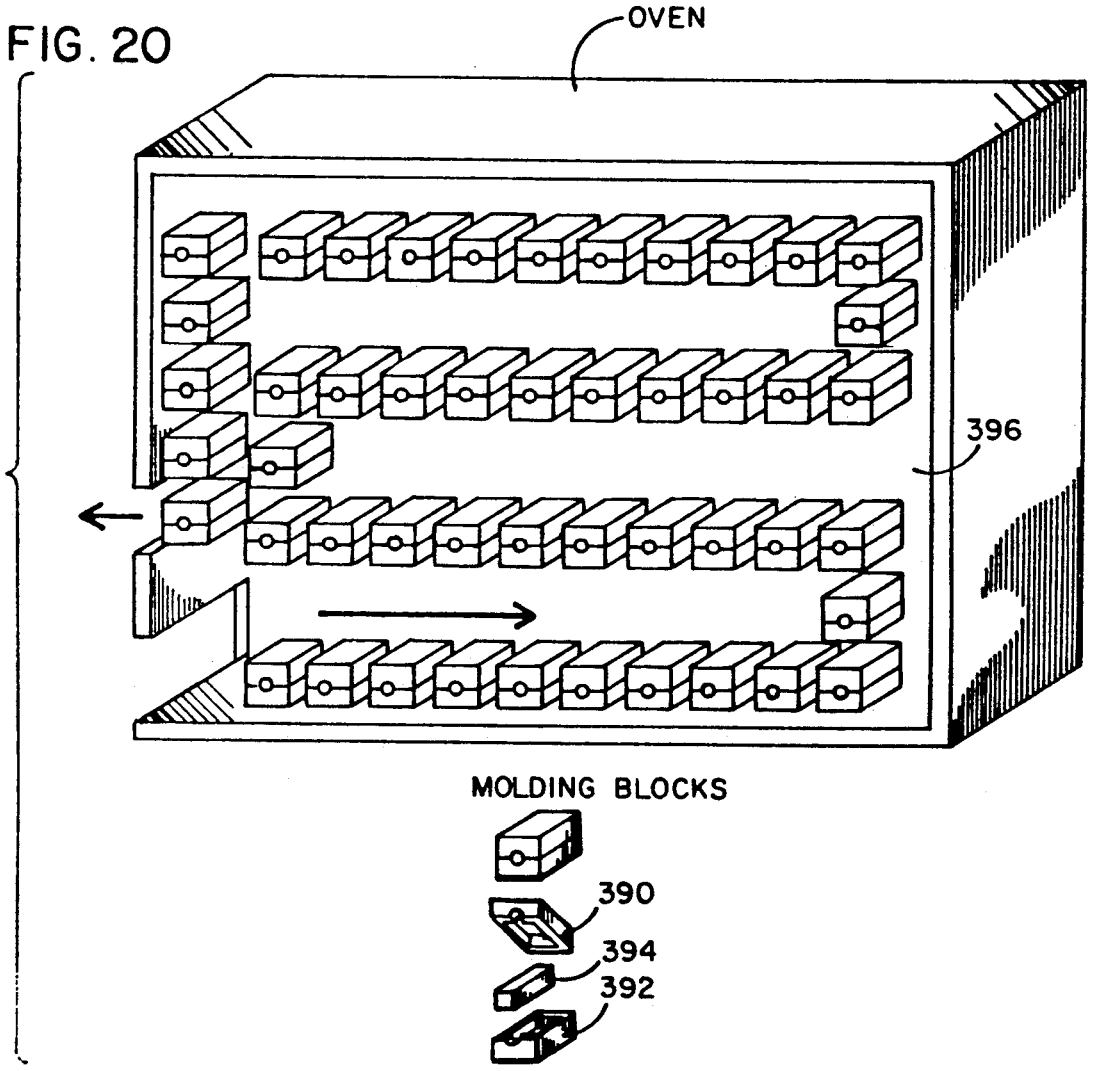

METALLIZED FIBER/MEMBER STRUCTURES AND METHODS OF PRODUCING SAME

This application is a division of application Ser. No. 186,391, filed Apr. 26, 1988, now U.S. Pat. No. 4,999,240, which is a continuation-in-part of my previous application for Metallized Fiber Structure and Method of Producing Same, Ser. No. 888,579, filed Jul. 21, 1986, now abandoned, which was a continuation-in-part of my previous application under the same title, Ser. No. 696,458, filed Jan. 30, 1985, now abandoned.

BACKGROUND OF THE INVENTION

1. Field of the Invention

The field of the invention resides in the area of the manufacture of structural materials out of fibers or members and more particularly relates to a structural material and method of manufacture of structural members from such structural material which can be made from fibers, such as formed from resin, which have been joined together at points of contact and, in some embodiments, such structure can be carbonized and metal coated.

2. Description of the Prior Art

The manufacture of fibers for various uses is well known in the art. Fibers can be manufactured by a variety of processes. An example of one process is the spinning process wherein the fibers are spun from liquid material in a central rotating reservoir having a plurality of apertures therein allowing the liquid, such as a resin, to flow outward through such apertures and to fall downward in streams where it solidifies into fibers. Coating on such fibers is also known in the art.

SUMMARY OF THE INVENTION

It is an object of this invention to utilize fibers or members from any source such as for example, but not limited to, spun fibers from a resin to construct extremely lightweight yet strong structural elements.

It is a further object of this invention to provide such structural elements which can be processed to a variety of stages to be in a form which can be best utilized for a particular situation. The composition of the structures manufactured under the method of this invention can be in the form of, but is not limited to, resins; cured resins; carbonized resins or metallized carbonized resins. In its basic form one embodiment utilizes synthetic fibers that are produced such as fibers spun out of liquid resins which solidify into fibers after passing through a rotating spinner, cure and fall into a vat where they pass into an escapement having means to catch a segment of such fibers and to segregate that segment from the main body of the fibers in the vat and to allow the segregated segment of fibers to fall in an irregular, meshing and intercrossing fashion into a mold cavity which could be, for example, in the shape of an I-beam. The mold can have entry and exit gates with the entry gate being used to allow the entrance of the fiber particles into the mold. Once the fibers have entered the mold, a resin solution can be entered into the mold through the same or another entry aperture in the mold. The liquid resin then soaks and saturates around all of the fibers thereby coating each fiber with the resin and the exit gate can open to allow any excess liquid resin to drain out therethrough. It should be noted that when the fiber mass enters the mold, it may still have some flexibility in its movement although somewhat hardened as it may still be warm from just having been formed. Once the fiber mass sits in the mold though, it will stiffen substantially due to its drying out and cooling. The liquid resin passed around the fibers must impregnate, surround and coat the fibers completely so that the resin will bond the fibers when such resin hardens wherever the resin-coated fibers make contact with one another thus forming an extremely strong structure. The fibers have many points of contact with one another and form a solid resin bond at each of such points of contact. The structure will thus become very strong but yet will be porous and lightweight, having a multiplicity of open spaces between the fibers and the fiber junctions. The method of entering the liquid resin and forcing it through the mold is but one method which could be used. Other methods of impregnating resin into the fiber mass could be utilized. It is important to provide some means for holding the fiber mass in the liquid resin or under the surface of the liquid because the fibers might tend to float to the surface if they were not restrained in some fashion. In one embodiment the mold chamber which contains the liquid resin solution and fiber mass can be equipped with both vacuum and pressure lines in order to help impregnate the fiber mass completely with the liquid resin. Alternate vacuum and pressure cycles can be applied to the mold until the solution has been forced thoroughly within the mass of the fibers and then any excess resin can be drained off or otherwise removed from the interlocking resin/fiber structure thus formed. The liquid resin with which the fiber mass has been permeated and coated can be, for example, a low concentration solution of phenolic resin in a low-boiling solvent or an undehydrated liquid single-stage phenolic resin. The undehydrated single-stage resins have the advantage of being easy to work with as their solvent is water so that fire hazards are at a minimum while their viscosity can be easily controlled and they need no catalysts for curing. When the balance of the excess liquid resin is removed, the remaining resin coating the fibers in the fiber mass can be cured by heating. In another embodiment the coated fiber mass can be first gently heated to drive off the solvent and then vacuum can be applied as the temperature increases. The vacuum step helps force out any remaining solvent but care must be taken not to apply too high a vacuum until the viscosity of the concentrating resins is high enough to prevent bubbles from forming. The vacuum is then gradually increased while the structure is still being heated until all of the solvent is removed. At this point there will have been formed a resin coating surrounding all of the fiber surfaces with resin bonds made between fibers of the interpenetrating fiber mass network wherever the coated fibers touch one another. In another embodiment a hot gas can be passed through the resin-coated fiber mass to drive off the solvent portion of the resin leaving just the resin. The hot gas can also cure the resin, making the fiber mass an integral structure.

There are many open spaces within the fiber bundles produced as described above but some spaces might be sealed off by the resin coating. To avoid this space-sealing, the coating should be very thin such as a phenolic resin solution which is sufficiently dilute to maintain the lightness of the structure. In the embodiment not using hot gases for drying and curing, the structure can be placed in an oven where the temperature can be increased slowly until the polymid resin constituting the fibers and the resin coating applied thereto have cured and thermoset. This temperature can be as high as 250 degrees centigrade. The structure thus formed is strong and can be used for a variety of purposes as a structural material. However the structure, if needed for uses requiring extreme strength or uses requiring temperature resistance, can be processed through further steps. The structure can be further baked in a furnace to be carbonized or graphitized under inert conditions by evacuating the oxygen and conducting such baking in the presence of an inert gas or within a vacuum. The resulting carbon structure would still be light in weight and stronger than the cured resin product, and would also now be conductive. Other products can be manufactured from this type of conductive structure. Since such a carbonized fiber structure is conductive, it can be electroplated directly. The structure can be placed in an electroplating bath with any soluble salt of metal to be plated. As the electroplating bath soaks into the inside of the carbon fiber mass and current is applied, the metal will be deposited on the fibers' surface and the bath can be circulated as the electroplating process continues. This circulation can be accomplished by many means including removing the structure from the bath and allowing it to drain and replacing the structure into new baths which have fresh electroplating material in them. The electroplating process is dependent upon the fiber density of the structure. If the fiber density is high, the structure may have to be closely confined in some containment means and the electroplating bath may have to be pumped through the containment means in order to permeate and properly electroplate all the internal portions of the structure. After the metal has been deposited on the fiber surfaces to the desired thickness, all of the residual electroplating bath can be removed by heat, vacuum and repeated washings. One of the reasons that the solvent of the liquid resin coating must be carefully driven off after the coating step by heating and vacuum cycles is to avoid bubbling of the resin coating and the possible curing of such bubbles. Removing the solvent carefully as described helps prevent porous fibers which might become saturated with the plating bath from having, as the plating continues over these pores or hollows, some of the bath being trapped therein by the plated skin. If in later processing the plated structure is heated, such as to drive off residual moisture, the trapped unsolidified bath in the pores would expand and rupture the plated skin which occurrence would destroy some of the properties of the structure. Careful removal of the solvent also helps to leave a smooth continuous resin layer without any undesirable resin bubbles on the fibers which bubbles might open and become depositories of unsolidified plating bath as the plating forms a skin thereover. Such plated bubbles might also interfere with the formation of strong junctions at the contact points of the fibers if such contact points are not completely coated. Ultrasonically vibrating the bath during plating helps to shake off any bubbles that form on the fibers.

After electroplating, the further step of placing a second resin coating over the external surfaces of the formed structure may be desired for some uses which exterior coating can then be carbonized. This coating can be sprayed or painted on. Another method of applying such a carbonizable coating is to coat the exterior of the mass with a carbonizable adhesive followed by the steps of dusting a carbonizable resin thereon, melting, and then curing the newly-formed resin coating. This new coating can only be carbonized if the melting temperature of the previously-plated metal is higher than the resin's carbonizing temperature. The structure can then be placed in a carbonizing furnace and the surface coating carbonized by heat. Since during carbonization shrinkage of up to 25% can occur, this process may be difficult to perform successfully as the coating can crack and shrink away from the fiber with a resulting loss of adhesion of the coating to the fiber. One must be careful to avoid shrinkage of any coating which could pull apart the junction of the carbon fiber substrate, and any such cracking at junctions will create poor fiber-to-fiber bonds. One way of overcoming this shrinkage problem is to start with uncarbonized fibers and coat and bond them together with a carbonizable resin, then cure the resin and carbonize the structure. In this way shrinkage of the fibers and coating will occur simultaneously and the resulting structure will have a smooth continuous surface. After carbonization is complete, an additional metal coating can be deposited on this new exterior surface by electroplating, sputtering, vacuum metallizing, etc. With the interior of the structure of the fiber mass being now sealed, the structure is stable and invulnerable to corrosive attack. In another embodiment the sealed structure can have the spaces between its fibers in its interior filled with a material such as a closed-cellular foam to make its interstices impenetrable to liquids or gases.

The structure produced by the process of this invention can take any shape, such as channels, I-beams or L-beams. Tubing can be produced, for example, by forming the structure of this invention around a core of expanded polystyrene that will not dissolve in the resin solution but will decompose during carbonization. Further, the structural shapes can include means for attaching themselves to one another. For example, male and female connecting joints can be coated with heat-curable cement and joined by dielectric heating through the structure. If an electrical circuit is completed through both sides of the joint with the cement itself being electrically insulative, the cement will then heat and cure, bonding the parts together. Such cement could contain metals and upon such dielectric heating through the carbon structural member, the cement would decompose to make the residues of decomposition available for bonding the plated material joints together.

The fibers can be curly in nature so that a large multitude of contact points will be formed and once joined will bring tremendous bridging and gapping qualities over the open spaces to form a very strong lightweight structure. Vibrators can be used to settle and compact the fibers within the mold and to keep the fibers flowing into the mold through the escapement from the fiber-producing means. Curly fibers or ones which have many turns and twists can be of benefit because such fibers will produce many fiber-to-fiber contact points when brought together which will in turn impart great strength to the finished product while maintaining low-bulk fiber density for lightness. Having many fiber-to-fiber contact points is very desirable because after the fiber mass is unitized by the resin coating, the effective fiber length between contact point to contact point increases the flexural modulous of the structure while the low bulk density is vital to maintain the lightness of the final product.

Structures made from the structural material of this invention can include, but are not limited to, aircraft parts, railroad ties, lighter-than-air aircrafts, frameworks for domes over stadiums or geodesic domes in general, framework and panels for mobile housing for military troops, and mobile lightweight portable bridges. Floating framework for sea harvesting also could be made.

BRIEF DESCRIPTION OF THE DRAWINGS

FIG. 8*a* illustrates a coated structure.

FIG. 8*b* illustrates a portion of FIG. 8*a*.

FIG. 8*c* illustrates the structure of 8*b* after fusing.

FIG. 18 is a view of a production of the materials to make the structure of this invention from waste resins including green oil, coal tar and the like.

FIG. 19 illustrates a pug mill used to mix materials to make the structures of this invention.

FIG. 20 illustrates the molding of railroad ties being one structure which can be produced using the process of this invention.

DESCRIPTION OF THE PREFERRED EMBODIMENT(S)

Figure 1:
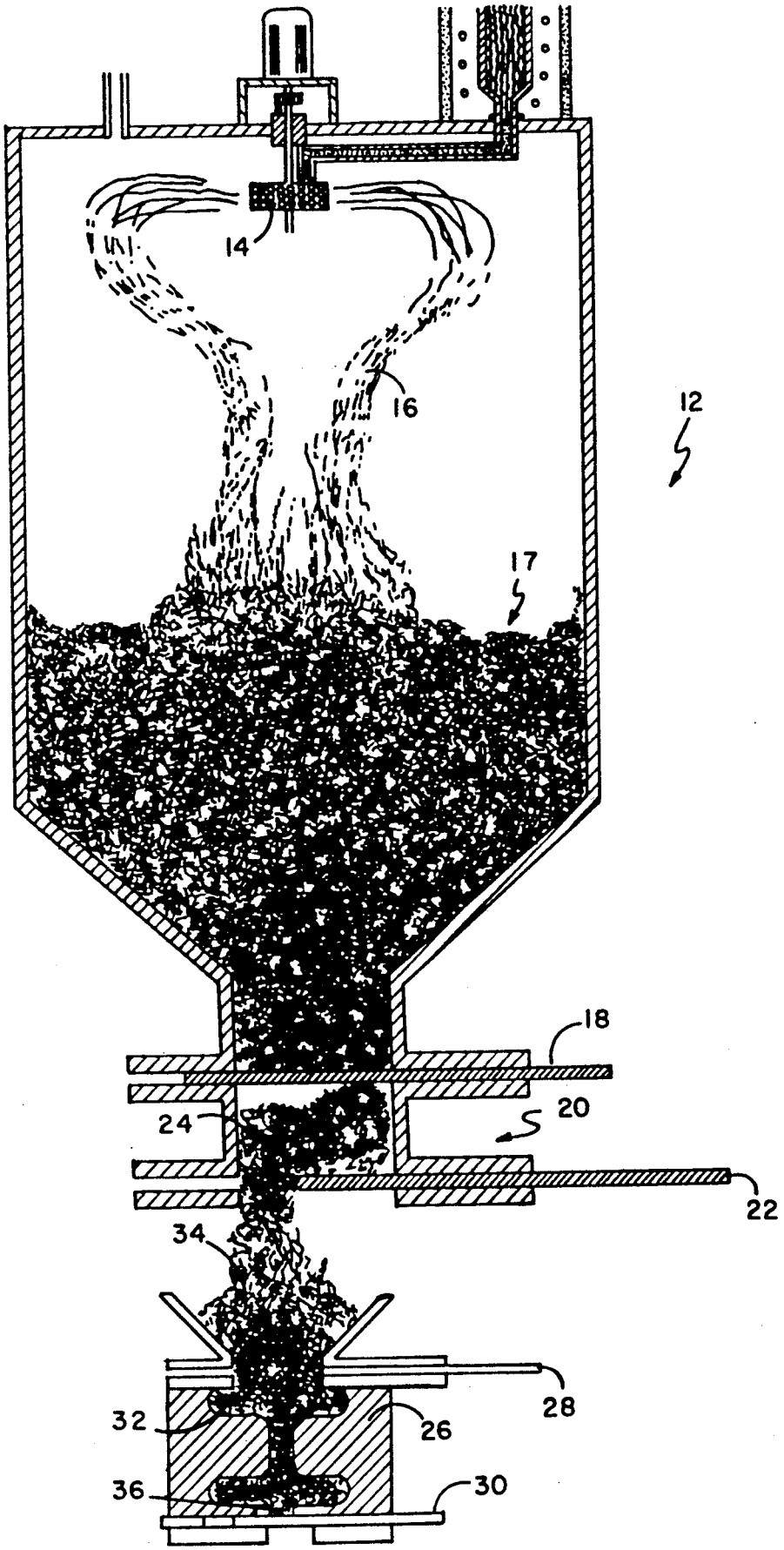
FIG. 1 illustrates an example of one method of production of fibers entering a mold through a measuring escapement.

FIG. 1 illustrates the initial step of the process of formation of the structure of one embodiment of this invention by the placement of fibers into a mold. It should be noted that the structure of this invention can be formed into any shape such as I-beams, channel beams, L-beams, tubing or any other solid shape. The shape illustrated is an example only and the structure of this invention should not be considered limited to such shape. A typical basket spinner 14 receives resin which it extrudes outward in streams 16 which fall into vat 12 becoming the formed resin fibers 17. It is desirable that these fibers be cured. If the fibers are uncured, later heating processes can cause them to sag and melt together or coalesce into spheres or globules. As mentioned above, any method for the production of fibers can be used in the formation of structural elements for this invention and the fiber spinning method is illustrative of only one of such methods. Typical fiber thickness would range from 10–1000 microns and length can be of a 2:1 aspect ratio to several feet or even yards if the fiber is flexible enough. Such other methods can include, but are not limited to, the production of fibers, including even metal fibers produced by turnings, shavings or by spinning. Turnings can be waste from lathe or milling operations. Any metal products from spinning, pulling or spraying of molten metals as well as products such as steel wool and crumpled foils or foils that have been slit can be utilized. Any of the fibers utilized could also be hollow.

Figure 2:
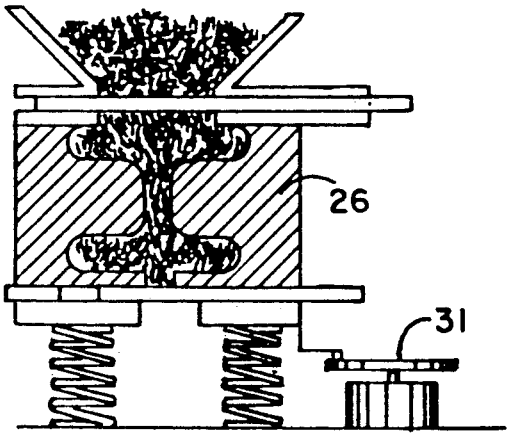
FIG. 2 illustrates the mold being closed with vibrating means to aid the entry of the fibers into the mold and the compaction of the fibers therein.
Figure 3:
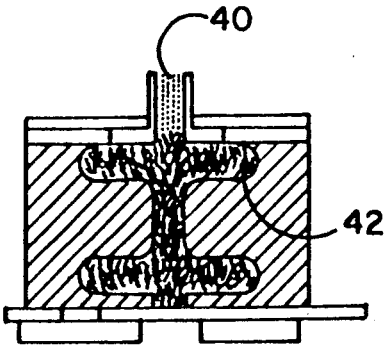
FIG. 3 illustrates resin solution being entered into the mold to surround the fibers.

An escapement 20 is provided beneath vat 12 with a first gate 18 which is adapted to slideably move back and forth and which is seen in a closed position having allowed a portion of fibers 17 to fall into chamber 24 before such portion was sealed off from the remaining fibers in vat 12 by closing gate 18. This segregated portion can then be entered into mold 26 by opening gate 22 allowing the fibers to fall into and through mold entrance 34 into mold cavity 32. First mold gate 28 can be in its open position to allow such entrance. Mold exit 36 can be provided but as shown is blocked by second mold gate 30 which is in a closed position. The fibers can be compacted into mold 26 by any suitable means such as physical pressure or by processes such as vibrations such as could be produced by vibrator 31 illustrated in FIG. 2. When the mold is filled and the fibers compacted therein, first mold gate 28 can be opened as a means for entry of the resin solution as seen in FIG. 3 where liquid resin 40 is pumped therein to form resin coating 42 on the fibers. The coating can be 1–200 microns thick subject to shrinkage from further processing as described below. While coating with resin is described herein as it is a good example of the creation of the structure of this invention, in some embodiments as described below such resin coating is not a necessary step to produce the structure of this invention.

Figure 4:
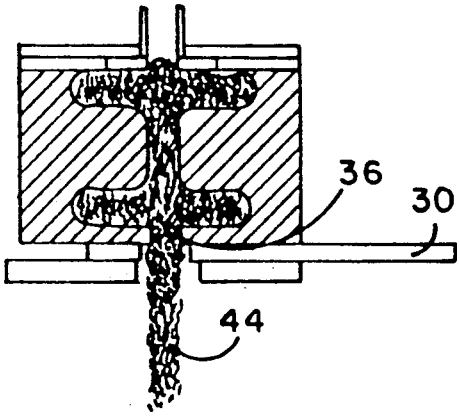
FIG. 4 illustrates the drainage of excess resin from around the fibers leaving a coating on the fibers and around their contact points with one another.
Figure 5:
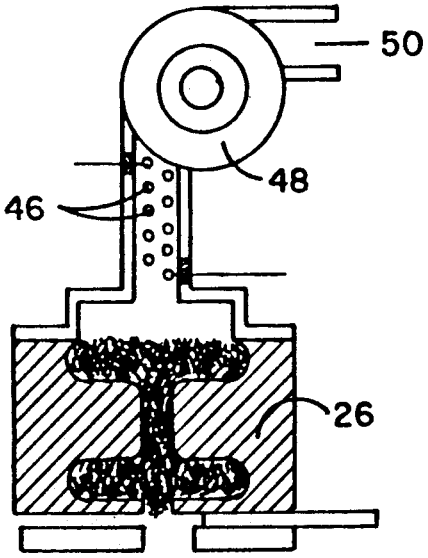
FIG. 5 illustrates one method of heating and curing the molded structure.
Figure 6:
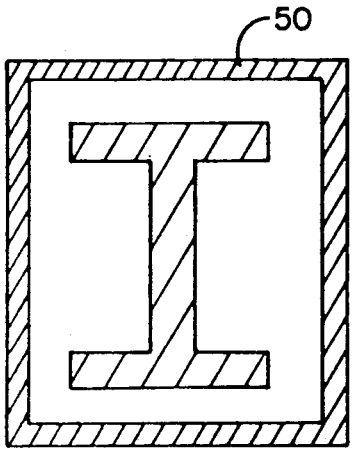
FIG. 6 illustrates the baking of the molded structure in a carbonizing furnace.
Figure 7:
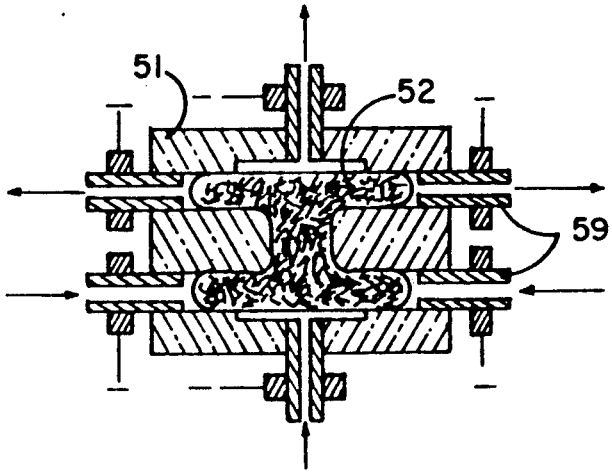
FIG. 7 illustrates the permeation of the molded structure with an electroplating bath.

In FIG. 4 second mold gate 30 is opened and excess resin 44 is allowed to leave the mold chamber. The mold can be then placed within a vacuum oven which vacuum will cause the solvent of the resin to boil away, forcing out any excess solution that might remain after the simple physical drainage as shown in FIG. 4. Heat can be applied by a variety of means as discussed in the Summary. As illustrated in FIG. 5 heated gas 50, blown by blower 48 and heated by elements 46, drives off any remaining solvent and cures the resin to form an integral connected mass of fibers held together by the resin coating with a plurality of spaces therebetween. The structure thus created can be used in a variety of structures as a construction material. Where high temperature resistance for example is important, the structure can be baked in a furnace as seen in FIG. 6 wherein the I-beam structure is shown within carbonizing furnace 50 where the entire structure is carbonized in an inert gas or vacuum. It is important that the structure of fibers be cured before such carbonization to prevent the initial heat of the process from melting the fibers causing them to lose their shape. Also it should be noted that during carbonization, the resin or other coating can shrink considerably, sometimes as much as 50%. In some embodiments it may be desirable to electroplate and seal the I-beam structure and this process can be accomplished by placing the structure in an electroplating bath which process would, if the electroplating solution is completely permeated into the open structure of the fiber mass, electroplate over all of the coated fibers and fiber junctions. The metallic coating can be from 200 microns to 1000 microns thick. Electroplating 52 can be seen on each fiber in FIG. 7 where the fiber mass is held within a combination bath tank/mold 51. Seen in FIG. 7 are ports 59 through which the electroplating solution can be pumped back and forth through the fiber mass to thoroughly coat each fiber. Ports 59 can also serve as one pole of the electrodes with the tank/mold serving as the other electric pole to pass current through the fiber mass for the electroplating. It should be noted throughout that the plating process is not limited to only electroplating and that wherever plating or electroplating is mentioned herein, equivalent plating such as electroless plating or coatings can also be utilized. It should be noted that ultra-thin metal film plating will not deposit a sufficient amount of metal to accomplish the goals of this invention. The plating must be of sufficient thickness to contribute to the strength of the structural material so that it can be used for construction. In some embodiments the fibers or members used are only for plating nucleation and/or to take up volume, and the plating is the strong element in the structure.

Figure 8:
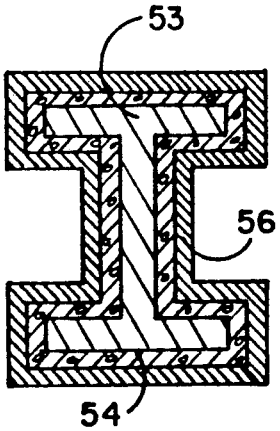
FIG. 8 illustrates the carbonizing of the coating on the exterior surface and electroplating of such carbonized surface coating.

A further embodiment of the method and structure of this invention requires a carbonized outer surface of the structural member. Seen in FIG. 8 is structure 53 which has been coated with a carbonized resin material 54 which is then electroplated with electroplating 56 forming a sealed corrosive-resistant structure. In some embodiments the sealed structure can have a closed-cellular foam material injected into all the open spaces of its interior making such interstices impenetrable to liquids or gases. Such foam material injection in one embodiment can be accomplished by injecting into the structure a liquid foaming resin that has just been catalyzed which after injection foams to fill the spaces.

Figure 8D:
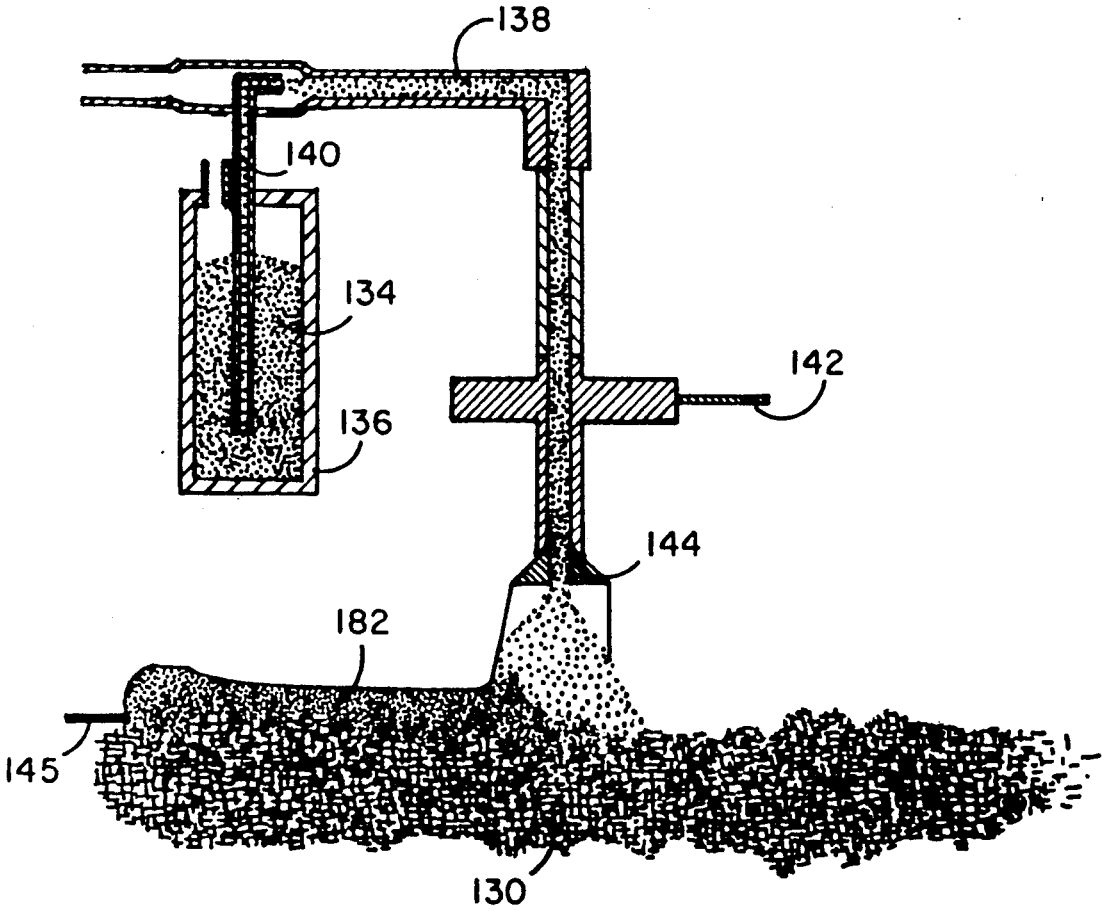
FIG. 8*d* illustrates coating of the structure by means of an electron plasma coater.

FIG. 8*a* shows a plated fibrous structure 120 sealed by a fused metal particulate 122 which penetrates only a short distance into fibrous structure 120. A section of a structure illustrated in FIG. 8*b* shows the metal particulate 124 held in place by a small amount of adhesive 126 which burns off during the fusing step to form coating 128 seen in FIG. 8*c* wherein the particulate has melted and fused to become mechanically bonded to the fiber surface of the structure and to the plating on the fibers. FIG. 8*d* illustrates an alternate coating procedure of a structure by means of an electron plasma coater. Equivalent techniques can be used such as with a flame plasma or gas flame sputtering. In FIG. 8*d* structure 130 is coated with a fused metal particulate 182. The metal particulate 134 in container 136 is pulled into line 138 by a venturi 140 and passes by first electrical pole 142 through carbon tip 144 within the high voltage plasma formed between carbon tip 144 and structure 130 in which is second electrical pole 145. The high heat of the electron plasma melts particulate material 134 as it is deposited on structure 130.

Figure 9:
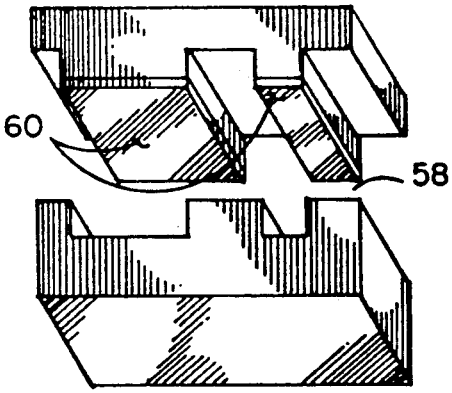
FIG. 9 illustrates a method of interlocking structural beams made of the structure of this invention.

FIG. 9 illustrates an example where the structure is formed with interconnection means such as beam interlocks 58 which can be directly adhered to one another by dielectric current passing through the conductive structural members. As described above, they can be joined with adhesive 60 positioned therebetween which could be of a heat-activated type which is activated by the heat produced by current passing through the structural members themselves when they are in contact.

Figure 10A:
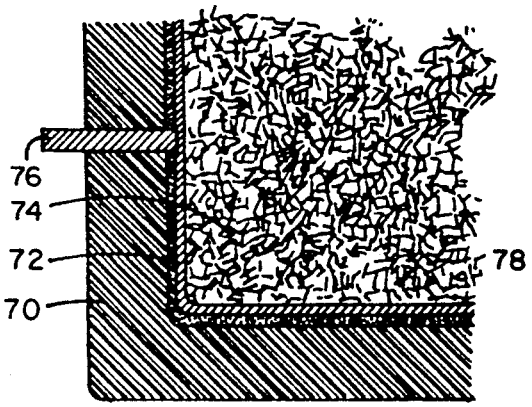
FIG. 10*a* illustrates molding of fibers joined by electroplating.
Figure 10B:
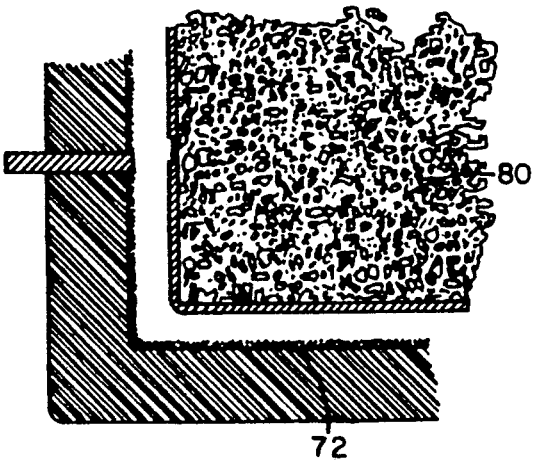
FIG. 10*b* illustrates the molded structure of FIG. 10*a* being removed from the mold.

In a further embodiment it is not necessary to bond a conductive fiber mass together with a carbonizable coating but rather to place the fibers tightly in a combination mold/plating bath container. The plating will form at the fiber junctions to fuse the fibers together as well as plate the entire fiber to produce a structure of great strength. Such a process is seen in FIGS. 10*a* and 10*b* where mold/plating bath container 70 is first coated with a high viscosity release agent 72 and then coated with a conductive paint 74 which makes contact with first conductive lead 76 from which any release agent has been cleaned. The fibers 78 are tightly placed in the mold to help create good fiber-to-fiber electrical contact and are plated forming structure 80 as seen in FIG. 10*b* where structure 80 has been released from mold 70 at its junction with release agent 72. The tight packing of the fibers is also necessary to assure that there will be no arcing at the junction sites which would cause electrolysis and prevent plating from forming on such sites. A second conductive lead not seen in these views completes the circuit for the electroplating process, but it should be noted that other plating processes can be used.

Figure 11A:
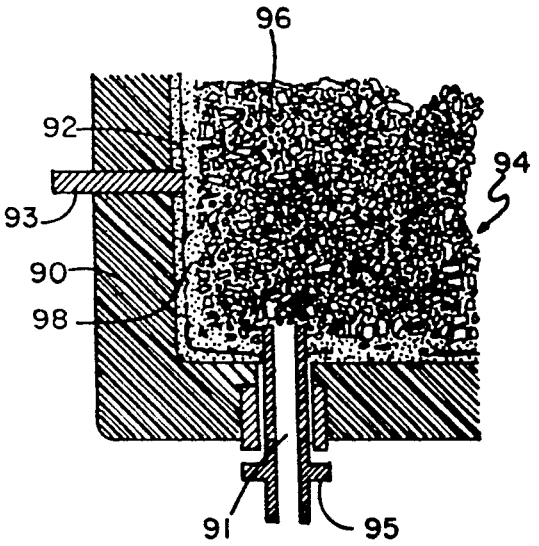
FIG. 11*a* illustrates molding of fibers joined by coating.
Figure 11B:
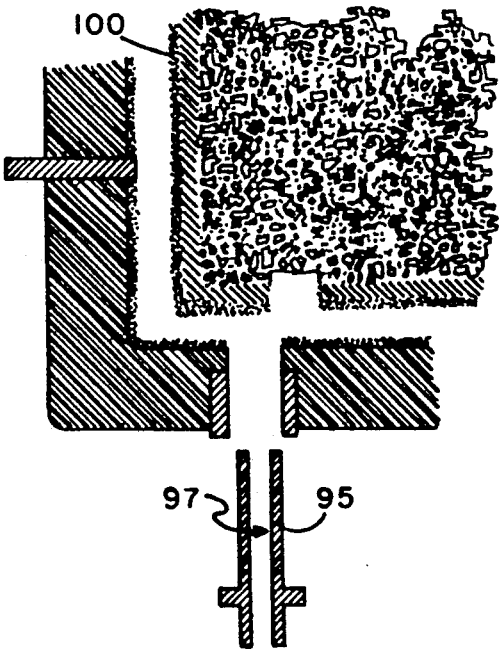
FIG. 11*b* illustrates the molded structure of FIG. 11*a* being removed from the mold.

The fibers of the plated structure do not have to be conductive. The process of coating a nonconductive fiber mass with a conductive material such as a conductive paint and then plating the mass by electroplating can also be used to create a structure of this invention. The fibers utilized can be of any nature such as organic polymers, glass or wood, for example. The application of the conductive coating can be done in the combined mold/plating bath container 90 as seen in FIGS. 11*a* and 11*b* with the nonconductive fiber mass coated with a high viscosity release agent 92 but which release agent, in some embodiments, is optional. The electrode circuit is completed through first electrode 93 and second electrode 95. Second electrode 95 can be part of a removable bath circulation pipe 97 which can be retracted from the mold before ejection as seen in FIG. 11*b*. When fiber mass 94 is in place in container 90, a liquid form of conductive material 96 is introduced therein to fill the entire container. After soaking the entire fiber mass 94, excess liquid 96 is drained from container 90 through drain 91 leaving a coating 98 on all surfaces of the fibers including the exterior surface which also coats the walls of the container. The wall coating can be used as a mold release as seen in FIG. 11*b* after plating is through, and the plating on the inside of the wall coating forms an outside metal skin 100 on said structure which can be useful in some finished products. In some cases it may be desirable to utilize non-conductive fibers and make them conductive by the process of micronizing. Micronizing non-conductive fibers can be performed by mixing finely divided graphite and the non-conductive fibers together and passing them both together through an air mill. Any excess graphite can then be removed by sifting.

Figure 12:
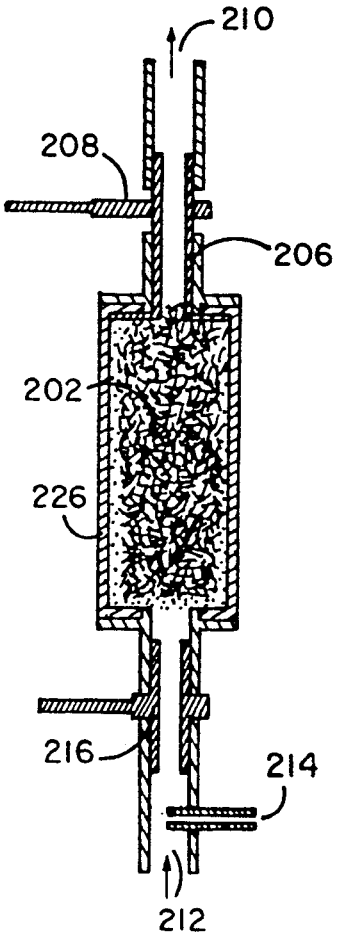
FIG. 12 illustrates a tank/mold for plating.
Figure 13:
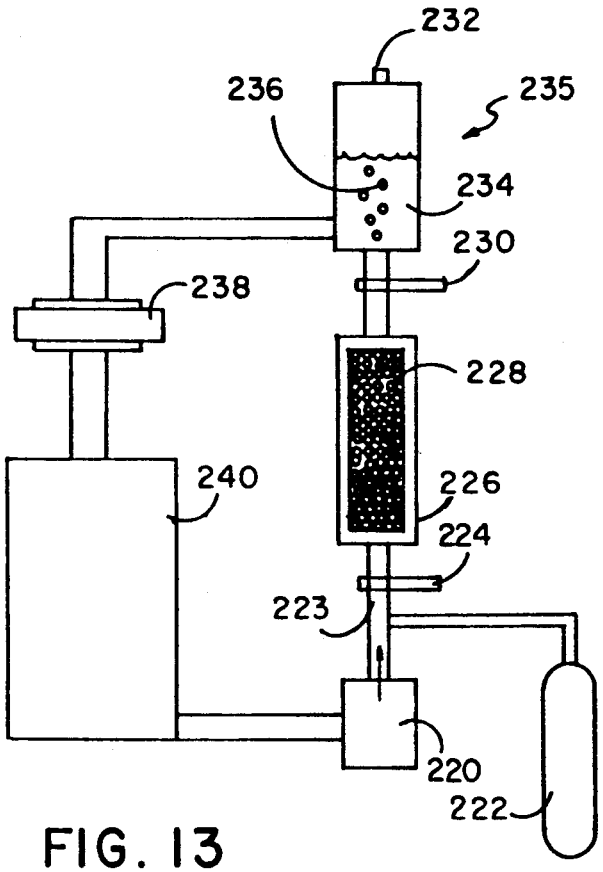
FIG. 13 illustrates a tank/mold system incorporating the tank/mold of FIG. 12.

FIGS. 12 and 13 show another plating tank/mold combination with the tank/mold 226 in FIG. 13 shown enlarged in FIG. 12. Basically the structure circulates a plating bath held in bath tank 240 shown in FIG. 13 which is pumped by pump 220 which can be an electrically insulated pump to prevent its internal components from being plated. Peristaltic pumps are also good for this purpose. Tubing 223 from the pump leads to tank-/mold 226 which tubing can be made of Tygon or equivalent material. A pole 224 is externally shown in FIG. 13 with its inside portion 216 seen in the enlarged cutaway view of FIG. 12 positioned within the inward flow of the bath 212 in tubing 223. Pole 224 is one of the electrical poles needed for the electroplating. The other pole 230 in FIG. 13 is seen in more detail in FIG. 12 as extending to an inside portion 206 which portion extends into tank/mold 226 and contacts fibers 202 therewithin. The bath exits by this pole through pipe 210. In some plating processes a gas from tank 222 is entered into tank/mold 226 through inlet 214 as seen in FIG. 12. The gas is important in certain plating processes because it produces a scrubbing effect on the surface of the plated fibers and can also have important chemical effects. In some embodiments the gas can be conductive. The conductivity of the gas is useful in the process because the gas acts to reduce the impedance/resistance of high PH baths where high current density is needed for good deposition but which at lower PH values the acidity redissolves the deposit. This conductive gas also may help reduce thieving of the plating by one or two nearby configurations which because of its surface area or mass can steal all of the metal in the bath and leave none in the area to be deposited on the other lesser configuration. It should be noted that whatever type of fiber is being used, whether straight, spiral, bent or otherwise shaped, it is best that the fibers and packing thereof be uniform to prevent this thieving of plating. The fiber mass will divide the gas finely, especially in highly packed fiber masses with fast bath circulation. It should be noted that the fibers introduced and held within tank/mold 226 may be prebonded or can be put in the chamber in loose bulk form in which case a screen may be needed at the upper end of tank/mold 226 so that no fibers escape out through bath outlet pipe 210. The bath outlet pipe can pass to a separator 235 as seen in FIG. 13 and the gas bubbles 236 can pass through bath 234 and escape through outlet 232. The bath is then recirculated through filter 238 back to the bath tank 240 so that it can be reused.

Figure 15:
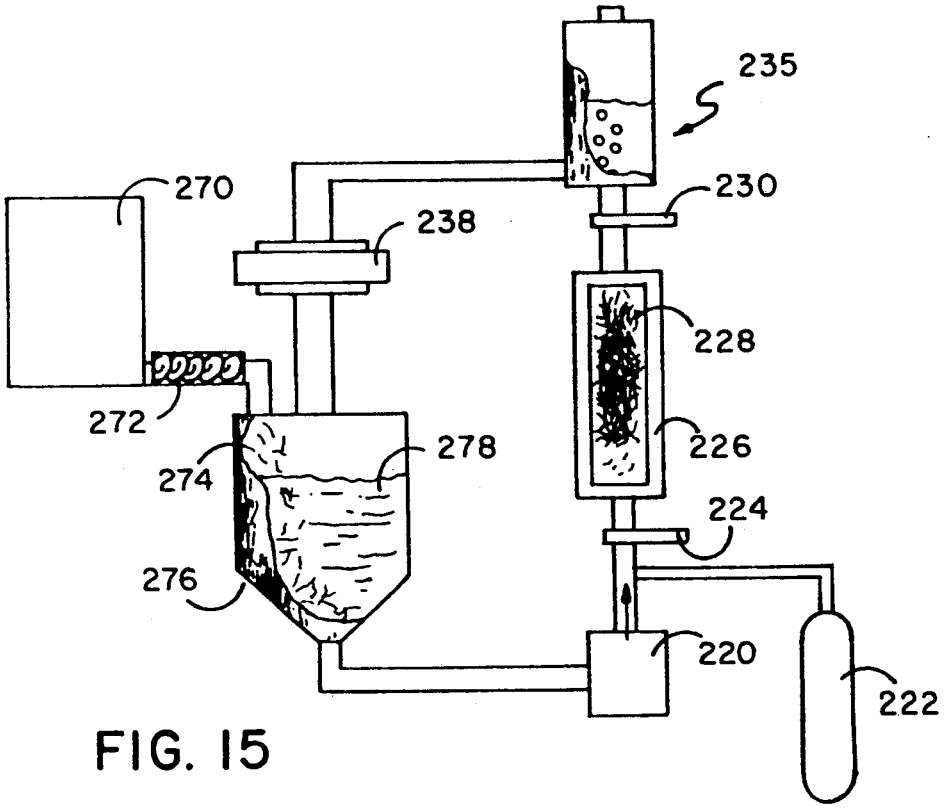
FIG. 15 illustrates a tank/mold system with fibers introduced in the plating bath.

In FIG. 15 a similar process to that illustrated in FIG. 13 is shown except that conductive fibers 274 are introduced from hopper 270 by metering auger 272 into plating bath 278 in bath tank 276. Conductive fibers 274 travel in bath 278 through pump 220 by pole 224 to become entrapped in fiber mass 228 in tank/mold 226. Conductive fibers 274 will assist in increasing the current density in tank/mold 226 and will help negate problems associated with plating edge effect and any lack of throwing power for any particular bath type.

Figure 16:
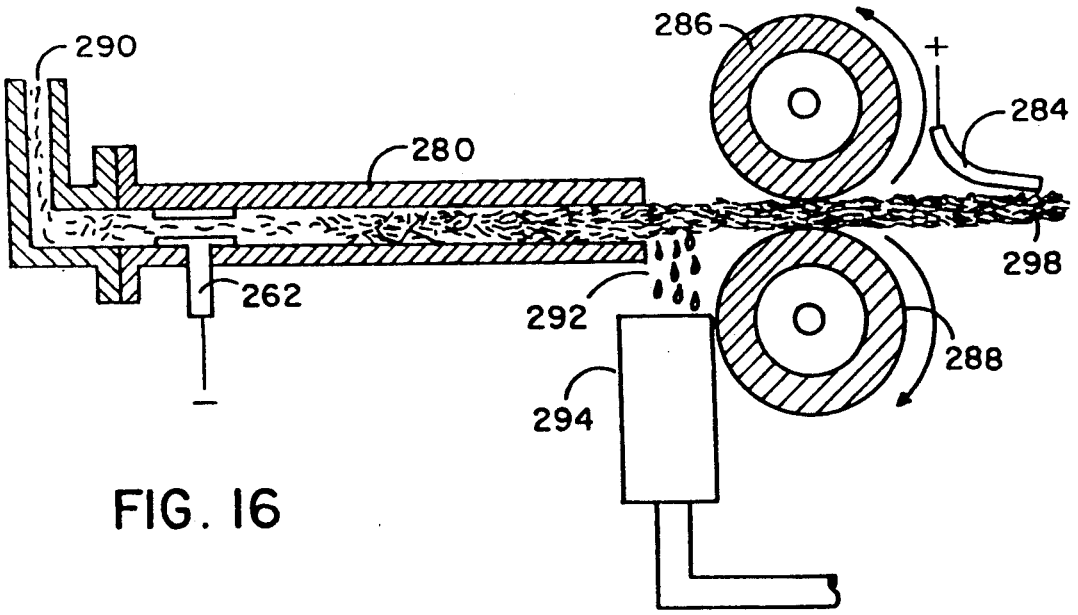
FIG. 16 illustrates a process for continuous production of a plated fiber structure.

FIG. 16 illustrates a continuous plating process for a fiber structure 298 where fibers 290 and plating bath 292 are entered into mold tube 280 which can be coated with Teflon or equivalent. The fibers/plating bath mixture passes by electrode 282 and the fibers build up in mold tube 280 as the plating bath 292 drains off into collection tank 294 and is pumped back through pipe 296 to be recirculated. The fiber mass is pulled by contact with rotating wheels 286 and 288 which pull the formed structure past second electrode 284. The current through the conductive fiber mass solidifies the plating on the fibers while still in mold tube 280 and this process is useful in producing a continuously produced article. If the plating in any bath is copper, the structure can be hardened by ultrasonic vibrations or heat in some instances.

Figure 14:
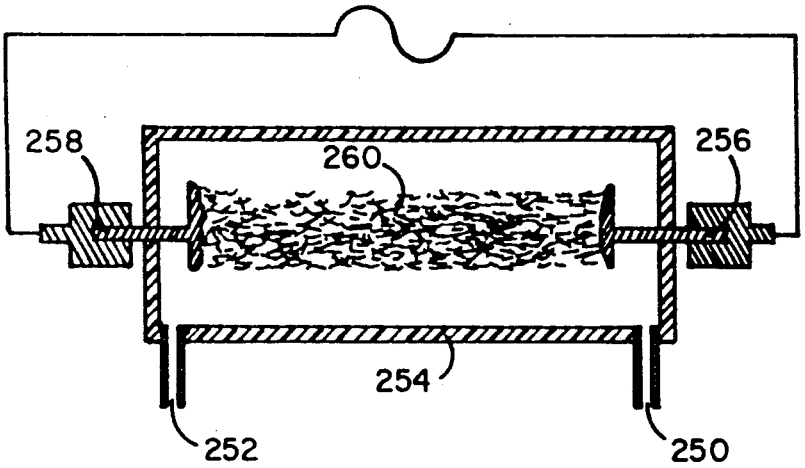
FIG. 14 illustrates a system of hard-casing fibers.

In yet a further embodiment as seen in FIG. 14 when it is desired to produce very strong members, iron plating can be deposited on fibers 260 of the type having a carbon core. The iron plated article is then placed under dielectric heating by current through electrodes 258 and 256 during which time the carbon in the core of the fibers is used as a source of carbon for carburizing the iron plating which acts as a process for case-hardening to make the exterior of each fiber harder than its core. At the same time nitrogen gas can be introduced into the chamber through inlet 250, circulated therethrough, and removed through outlet 252 or, in an alternate embodiment, can be pressurized in the chamber thereby nitriding the carbon content of the iron coating. Spent iron-plating pickling baths from the steel industry or scrap iron dissolved in acid could be used as an economical plating bath.

In another embodiment carbon precursers such as wood fibers can be impregnated with a carbonizable uncured resin. Excess resin is then drained off. The resultant resin-impregnated wood fibers are fluffed up and placed in a mold where heat is applied to cure the resin, and the melting of the resin during this heating cycle will fuse the coating at the contact points of the fibers together to produce a rigid structure. The resin impregnation of the wood fibers produces solid wood fibers in the structure which wood fiber if not impregnated would be otherwise porous and produce a poorly finished product. The structure thus produced is carbonized to make it conductive. The carbonized structure is then plated such as by being electroplated with iron from a plating bath composed of ferrous sulfate or other equivalent ferrous plating material to make it strong. The plating bath can be then exchanged with a bath to plate on the iron surface a plating that is nonrusting such as chromium. A structure produced from wood fibers would be very economical as the materials are cheap and abundant. Other carbon precurser members could be utilized which members are not necessarily fibrous such as pine needles, whiskers, wood shavings, sawdust, ground pine cone where the products of grinding have been classified to sort out the seed husks, ground fish skins or other organic animal products which yield carbon residue, course bone meal and even waste paper where the paper has been slit or rolled into balls or otherwise processed to cause packing of low density. These materials must be used in a dried form such drying can be accomplished by heating the material in a forced air or vacuum oven. The material must be dried because if the resin coating is placed on the material before it is completely dried, the moisture escaping during the curing and carbonization stage will destroy the product. The drying of such material helps provide the necessary porosity in the material so that during the resin soaking stage the resin can penetrate and after the solven is removed, a nonporous structure of superior strength and of good surface quality for plating is left. Glass fibers can also be successfully used as a core material.

Another source of the fibers, from which the structures of this invention can be made, is produced by the spinning of slag fibers on site at coal-fired electric generating plants. Presently molten slag, produced at the firebox in coal-fired electrical generating plants, is fed through water-cooled "monkeys" into a water bath where the thermal shock breaks the slag into small granules which may be ground to a finer material by crushers. The granular slag is presently used for road fill, sand blasting media, or aggregate in concrete blocks. In the processes and structures of this invention this slag material can be spun into fibers while it is still molten as produced from the firebox in the coal-fired electric generating plant. This use provides a great economy because one does not have to transport the slag material to a processing site remote from the firebox of the coal-fired electric generating plant nor does one have to remelt the slag at the remote site. There are further savings in associated factory overhead and labor. The slag material is generally of low cost and other refuse and residual-type materials can be incorporated into the same structure with the slag produced fibers.

Figure 17:
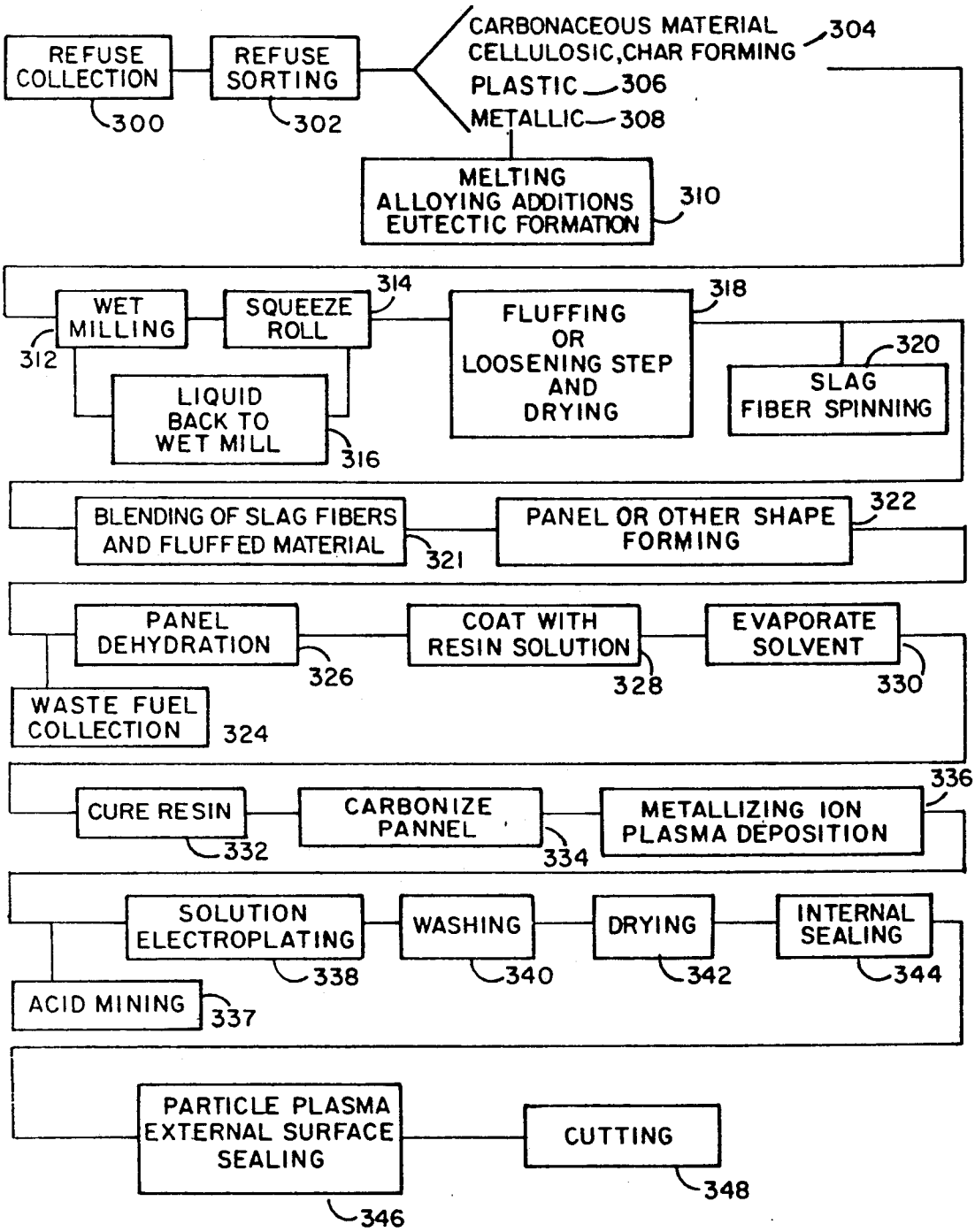
FIG. 17 is a block schematic view of a system for the production of the structural material of this invention from waste materials.

FIG. 17 illustrates a schematic diagram to show the utilization of refuse, waste fuels and other waste products to produce materials that are useful in forming the structures of this invention. Block 300 illustrates refuse collection such as from municipal waste dumps and the like which refuse is sorted in block 302 as is frequently done to make use of recyclable materials. Such material is separated for the purposes of this invention into carbonaceous material and cellulostic matter 304, plastic matter 306 as well and metallic elements 308. The metallic elements can be separated by magnetic devices as is well known in the art in the case of ferrous metals. In the case of non-ferrous metals such as aluminum, such metals can be separated out by inducing a field in the aluminum and then repel displacing the induced aluminum with a second magnetic field coil. Such metallic members can be melted with various alloys added thereto in block 310. The cellulostic portions of the material would contain mostly paper from packaging material and the like. The plastic or organic polymers which would comprise the carbonaceous material 304 are quite common in refuse and cause problems in disposal which the utilization and production of the structures of this invention would help to solve in addition to providing useful structural material. Part of the cellulose and plastic portions of the refuse can also be used as fuels for heat in the further processing steps of this invention. The other portions of the plastic and carbonaceous material is left with the cellulose material since it contributes to the carbon yield and aids in the production of certain internal surface cellular structures useful in the formation of the structure of this invention which are formed during the carbonizing steps as described below. The metal portion of the refuse can be melted together on site with chemicals, as seen in block 310 added to the melt to cause an alloy or eutectic homogenous single phase to form. This eutectic material can be cast into rods which rods can be used later in the process for electrosputtering or ion deposition coating of the internal surfaces of the open porous carbon structure. Cellulostic matter 304 and plastic portions 306 of the materials can be ground in wet mill 312 in which grinding process water can be added to the refuse. These wet grinding processes are known in the art of making carboard. The particle size of the material is reduced by the milling to create a uniform mass or pulp. The wet mass produced is put through squeeze rollers 314 where most of the water portion is removed which can be directed back at block 316 for further wet-milling of the cellulostic and plastic portions of the material. It also may be advantageous to use a water-soluble single-stage high carbon residue resin solution as the wetting water portion in the wet grind step which step will then treat the refuse mass with a resin which can be processed in later steps below. This resin will concentrate on the refuse paticulate and will contribute to the binding of the particles during formation. This reuse of the water will keep environmental contamination to a minimum. The production from the squeeze rollers is a wet cardboard-like mat which is passed on for further processing. Water, though, can be removed from the pulp by other steps such as centrifuging which would yield a less dense mat structure which could be separated into individual fibers more easily than a mat produced by squeeze rollers. The mat produced is then processed into individual fibers in block 318 by passing the mat through counter-rotating differentially geared members with ring teeth such as utilized currently in carding processes where air is added into the mass causing the particles to be separated and fluffed up. At this point in the process from block 320 the slag fibers which can be spun on site at a coal-fired electric generating plant as described above can be introduced and mixed in various percentages into the still moist reduced refuse matter produced from the fluffing process in block 318. This addition of relatively long fibers produced in the slag fiber spinning process into the mixture causes the blend to have a low bulk density with many interconnecting interstices which assist the passage of resin solutions therethrough as described above. The still moist mixture of slag fibers and reduced and processed refuse material is then molded into a shape such as by a felting process, and in some cases the squeeze rolling or centrifuging step could be bypassed if the felting process were used, or by continuous belt-molding processes, compression molding, centrifugal forming or by any suitable forming process as seen in block 322. The structural shapes from block 302 can still be from a moist slag fiber refuse particulate mixture or can be dried completely before resin solution treatment such as, for example, passing the mixture through an oven such as panel dehydrator 326 for baking. The process at this step will depend on the final nature of the structure desired.

Block 324 in FIG. 17 illustrates waste fuel collection. Since the processes of this system utilize waste material, it is envisioned that waste fuels such as burn-off gases from refineries, parts of the refuse itself, and other wastes from manufacturing plants can be used for fuels to produce heat or form deposits used in the drying or carbonizing steps of this invention. The waste fuels are to be collected from remote sites and transported to the manufacturing site of this invention.

After the shaped product is dried in the panel dehydration oven 326, a low viscosity solution such as a single-stage phenolic resin dissolved in ethynol can be passed through the thus formed mass of material as seen in block 328. This process can be done continuously on an endless screen belt and such coating of the resin/solvent solution should be left on the internal surfaces of the structure including the junctions where the particles, fibers and slag fibers make contact. This coating forms not only on the fibers and particles of material itself but also joins the fibers and particles together where the resin makes contact between the touching points of the fibers and particles thereby binding them by such resin when the resin hardens. The solvent can be removed by heat and evaporated in block 330 at which time the resin concentrates on the surfaces and the junctions between particles thereby binding them together. The evaporated solvent can be passed through a condenser where it is reliquified and sent back to the resin/solvent combining site for reuse. The coated impregnated structure can be put into an oven or furnace where the temperature is ramped so that the resin cures or thermally sets such as in block 332 and then the temperature can be increased further to carbonize the panel in block 334 which carbonization will produce an open-cellular electrically conductive carbon structure.

Carbonizing temperatures reached in an oven should not be sufficient to melt or devitrify the slag fibers. A certain amount of slag fiber sagging is produced under some conditions and for many uses this sagging can be advantageous. The cellulostic portion of this mass can be carbonized into a char similar to a charcoal, and the resin coating can be carbonized into a glassy carbon structure. The temperature ramp should be controlled so as to produce the strongest structure. This temperature rise can be done continuously around a conveyor belt carrying the structure through an oven with different temperature zones therein. The solvent removal step in block 330 can be combined into this curing/carbonizing step. Carbonizing times can be of very short duration because the cross-sectional area of the irregular internal cell walls is low.

Further steps in the processing can have the internal surfaces of the structure coated with a thin layer of metal via an ion deposition process shown in block 336 where electrodes are placed above and below the carbon structure with the carbon structure acting as one of the electrodes. Alternating current can be passed from a top electrode to a bottom electrode with the top electrode having means for passing a metal rod into the plasma formed between the top and bottom electrodes. This process is well known in the art of electron plasma sputtering deposition. The cast metal rod thus becomes an electrode. The carbon structure to be plated is the ground electrode at selected periods of time so that the accelerated metal ions in the plasma are attracted to the ground, decelerate and are deposited on the internal surfaces of the open-cellular carbon structure. Some of the cast-metal rods used for the metal portion in the ion deposition process can be produced at block 310 from the metal portions of the refuse separation. The metal plating deposits on the carbon are not generally of the adherent type, that is to say, the metal plating deposits on carbon do not have strong bond-forming characteristics. Ion deposition is first necessary so that strong mechanical bonds between the plated metal and the carbon can be produced.

During the metal ion deposition process the ions are deposited onto the very small fissures, caverns, craters and other irregularities on the internal surfaces of the structure. These plated surfaces provide very clean and chemically uniform surfaces which are good for forming covalent bonds in the later thick plating deposition step. The processing variables during the evaporation, curing and carbonizing step determine the surface characteristics. Very fast processing will generate a very open cellular foam structure on the refuse carbon and carbon-coated slag substrate. The chemical makeup of the sputtering rods should be determined in the alloying step of the refuse metal processing. The metal ion deposition process is known to those skilled in the art of preparing metallic surfaces to be viewed in electronic microscopes.

The next step seen in block 338 deposits thick layers of metal onto the ion-plated surfaces using the process of electroplating deposition. The metal-to-metal bonds formed are very strong and the mechanical bond of the ion plating is strongly bonded to the carbon to produce a strong structure as a whole.

The plating solutions used in block 338 in FIG. 17 for the thick plating step can be procured from acid mining businesses where acids are used to extract metal directly from raw mining deposits. The metal-laden solutions are clarified by filtering or centrifugal action. Such metal-laden solutions can be transported from the mining site to the site of manufacture of the structure of this invention and are used to plate the thick deposit layers. The acid mother liquor left after the metal is removed in the plating step is then transported back to the mining site where it can be used for further metal extraction. By passing the plating solution through the pores of the structure while a current or other electric potential is passed through the solution and structure which is conductive, a thick plated layer is produced throughout all the internal cells of the structure. At some points when plating with highly concentrated plating solutions at high potentials, treeing occurs which forms metal fibers that sometimes bridge across the carbon particulate fiber masses. Treeing contributes to the structure qualites of the finished structure.

It is also possible to perform decomposition plating on the internal surfaces of the structure when the structure is held at high temperatures by dielectric heating. A compound that decomposes upon heating is sprayed at the structure and passes into the pores. Such compounds decompose leaving the metal portion of the compound as a metal coating and other products of the decomposition being volatile at these high temperatures will leave the structure as a gas.

After the thick electroplating indicated in block 338, the structure is washed in block 340 and cleaned by forcing washing fluids through it and then dried in block 342. Heat-treating and carborizing steps can also be performed if desired. Dielectric heating can be used where various gaseous or gasified elements or compounds are pressurized within the structure. The structural panel or other form produced is cut to length or to a desired shape in the manufacturing process. In some processes the external surface of the structure can be sealed by particle plasma which also could be heated by laser devices as seen in block 346 to produce the final structure which is cut to size in block 348.

One example of structures that can be made from such a manufacturing process, as diagramatically illustrated in FIG. 17, are railroad ties. Railroad ties have a simple rectangular configuration and it is advantageous to produce them from a material that is strong, inexpensive and easily utilized.

Figure 18:
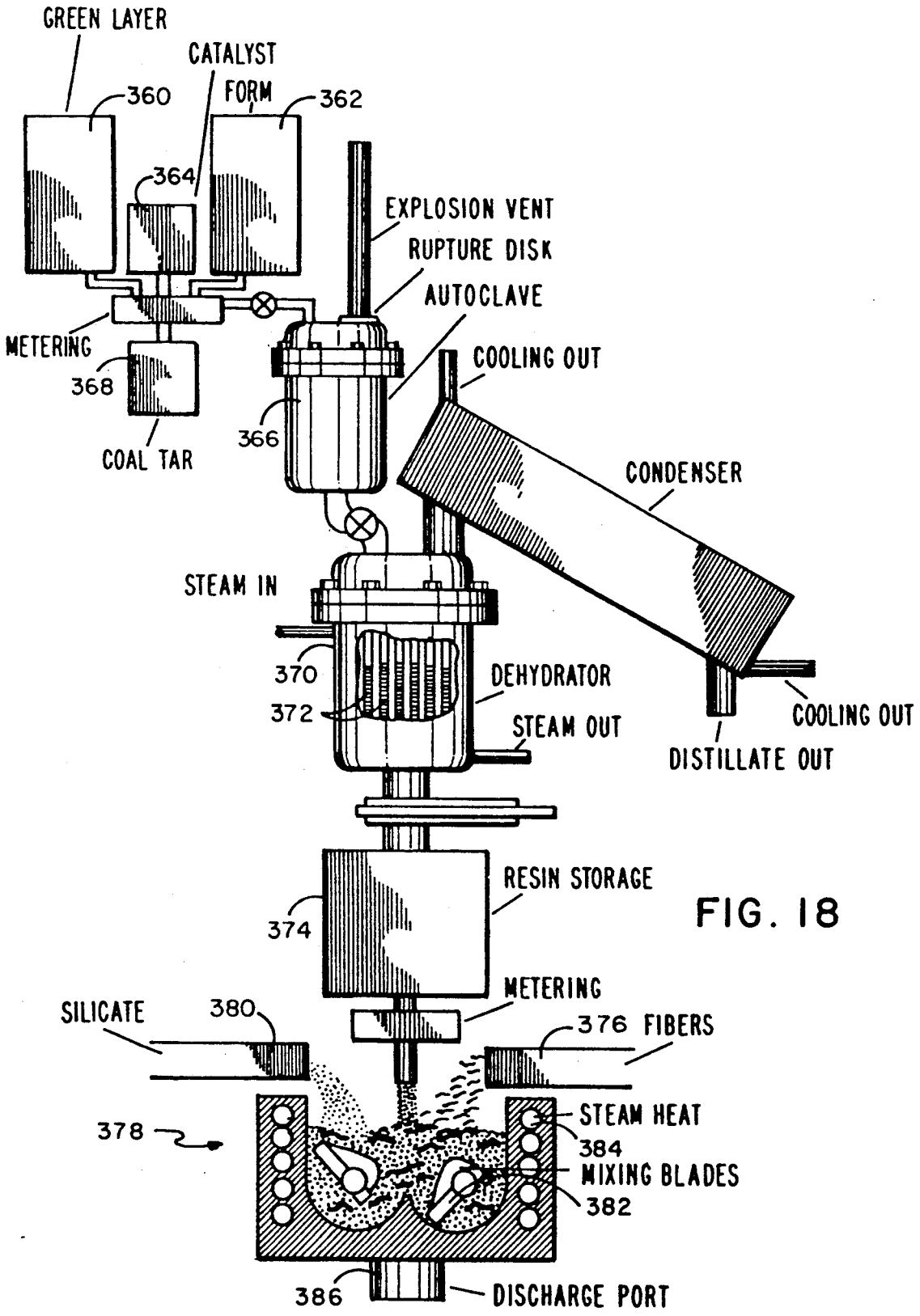

One type of resin in block 328 of FIG. 17 that can be utilized in the production of railroad ties is a phenolic resin which is a byproduct of green oil which forms as a layer on the bottom of a condensate in plastic production. This process is illustrated in FIG. 18. The phenolic industry has not yet found a way of economically disposing of this green oil layer. Resins called salvage resins can be made from green oil by various methods but these resins when used in molding compounds are very slow to cure and do not usually justify their use when compared to the cost of press time. Attempts have been made in the past to blend them into molding compounds along with production resins to dispose of the green oil layer, but since salvage resins usually are the product of many different types of production resins all with varying ingredients, uniformity cannot be controlled so that blending it into production molding compounds at a usage level high enough to be useful to get rid of this waste product causes great difficulty and poorly produced product. Some producers presently get rid of the green oil layer by burning it as fuel in their boilers.

It is an object of this invention to utilize this waste material by creating a central receiving point where green oil layer materials can be collected from phenolic resin manufacturers to be crossblended and reacted into a uniform suitable resin for the production of making railroad ties or other materials.

The usual composition of the green oil layer is as follows:

65% phenol
15% benzodioxane
10% water
10% cresol, dimers, trimers and traces of formaldehyde The green oil acts basically as a phenol and the benzodioxane acts as a very low molecular weight, single-stage resin. As shown in FIG. 18 the green oil can be reacted with an aldehyde such as formaldehyde 362 to produce a curable resin. Also useful in a similar way are coal tar 368 and resorcinol materials which are byproducts of the forestry industry which materials can be used to make inexpensive resins alone or mixed together with other waste resins such as the green oil layer resin mentioned above.

While there are several ways of reacting or making such waste resins into useful products, one such method refluxes the green layer with aqueous formaldehyde, dehydrates it to remove the water portion of the formaldehyde solution, and the product from the polycondensation reaction forms a usable resin. The preferred method of reacting the green oil layer, coal tar 368, resorcinol and formaldehyde 362 together with catalyst 364 is in autoclave 366 under acidic conditions. The heat produced by the reactants is sufficient to carry the reaction to near completion without the need of additional heat. A preferred method of producing the resin of this composition is to use paraformaldehyde which does not have to be in solution to remain stable. The advantages of using paraformaldehyde is that after the reaction is complete, there does not have to be much water removed by distillation in the dehydration process since the formaldehyde 362 is entered as a reactant in the dry form. Heat, usually in the form of steam heat, used for dehydration is an added cost in the production of this resin and the gain in quality by using another reactant with more water does not necessarily justify such reactant's use. Although paraformaldehyde is more costly than aqueous formaldehyde, the savings in the heat production costs and increased turnover rate are quite advantageous. The reaction time in autoclave 366 could be as short as 20 minutes depending on the size of the reactor and when the reaction is completed, the resulting product is channeled into dehydrator 370. The dehydrator is equipped with vertical steam pipes 372 to heat the material quickly and drive off the water made from the polycondensation reaction and any water that may have been added to the autoclave to help in the process. The dehydrator removes the water before the material in the autoclave is finished and the dehydrated resin is channeled into holding tank 374 and is then refilled by a valve from autoclave 366. It should be noted that certain additives can be added at the dehydration stage along with other resins for enhancing the weatherability of any molded products. The bubbling action of the product in the reactor is also good for fluxing any additives into the product, and it should be noted that any additive could be a reactive one.

A further major component in the structure can be provided to reinforce the fiber which fiber, as discussed, can be made from the slag produced in coal-fired generating plants and which fiber can be entered from pipe 376 into pug mill 378 shown in FIG. 19. Also entering the pug mill are the resins from resin storage tank 374 and other materials such as silicates 380. The pug mill has mixing blades 382 which mix all these products together, and the mill is heated by steam heat 384. The mixed product can leave the mill through discharge port 386 when desired. As seen in FIG. 19, blades 382 rotate down the length of the trough. Pug mills have a relatively gentle action and since the fibers used are rigid and their length is desired to be preserved, the pug mill, as mentioned, can be heated by steam heat 384 so that the resin will remain in a molten form while it is mixed with the fibers and other fill materials such as from the fluffing or loosening step seen in block 318 in FIG. 17. The resins in some cases may not be fully dehydrated and their consistency at room temperature is very much like putty, but these resins with an increase in temperature will melt down to be a thinner liquid with a wetting capacity suitable for very high fill percentages. Because the length of the fiber is desired to be maintained through its processing in the pug mill and injection into a mold, the preservation of the fibers is quite important. The paddles of the pug mill gently mix the resin, filler and fiber mixture as it moves down the trough until it reaches the end of the trough where there is discharge port 386 at the bottom where the material is forced out and into a cylinder equipped with a piston which will force this molding material into a railroad tie mold if that is the desired structure to be produced. In the production of railroad molds because the molding operation has to be quick, fast and inexpensive and since the resins are of a slow-curing type, positive clamp molds can be utilized which are passed through an oven which maintains their temperatures while the material inside cures. The separate molding blocks can be made of cast iron so that their production and replacement will be of low cost.

FIG. 20 shows a typical oven with upper molding block 390 and lower molding block 392 and molded railroad tie 394. They can be stacked in oven 396 for a long period of time to cure. After each block has passed through the curing oven 396, the tie can be removed from the molds by means of hydraulically separated mold components. The angles of the mold cavity should be open enough to allow the tie to be easily removed.

Materials listed in the following examples could be utilized to produce ties.

| | |
|---|---|
| Example 1: | |
| resin | 15-35% |
| slag fiber | 65-85% |
| Example 2: | |
| resin | 15-35% |
| slag fiber | 30-60% |
| silicate sand | 5-55% |
| Example 3: | |
| resin | 15-35% |

-continued

| | |
|---|---|
| slag fiber | 15-50% |
| ground mine tailings | 15-70% |
| Example 4: | |
| salvage resin | 10-30% |
| production resin | 5-20% |
| slag fibers | 25-45% |
| reprocessed foundry skimmings | 5-60% |

One advantage of plastic ties produced from the waste and under-utilized materials utilized in the process of this invention is that they will be more uniform than those ties made of wood. Ties produced by the process of this invention will be advantageous for use in magnetic rail systems where precision will be important for a vibration-free rail to yield a smoother ride for those using the rail system.

Although the present invention has been described with reference to particular embodiments, it will be apparent to those skilled in the art that variations and modifications can be substituted therefor without departing from the principles and spirit of the invention.

I claim:

1. A method for producing a structural material, comprising the steps of:

collecting refuse;

sorting said refuse into its carbonaceous, cellulosic, plastic and metallic components;

wet-milling said carbonaceous, cellulosic and plastic components to form a pulp;

removing the water from said pulp;

fluffing and drying said pulp;

spinning fibers from slag at said slag's point of production;

blending said fibers with said dried pulp;

shaping said fiber/pulp mass with said fluffed fibers irregularly arranged with portions of said pulp and fibers contacting other portions of said pulp and fibers forming at said points of contact a plurality of junctions and a plurality of irregular cells between said fibers and fluffed pulp;

dehydrating said mass by heating;

impregnating said mass with a resin solution;

coating said fluffed pulp and fibers with said resin solution, such coating also coating over said junctions; and solidifying said resin coating holding said fluffed pulp and fiber together at said junctions by said solidified resin forming a structural material.

2. The method of claim 1 further including the steps of:

carbonizing said structural material;

metallizing the internal irregular cells formed in said structural material by ion deposition; and depositing a metallic plating on said metallized surfaces.

3. The method of claim 2 further including the step of:

sealing the external surface of said structure.

* * * * *